US005617462A

United States Patent [19]

Spratt

[11] Patent Number: 5,617,462

[45] Date of Patent: Apr. 1, 1997

[54] AUTOMATIC X-RAY EXPOSURE CONTROL SYSTEM AND METHOD OF USE

[75] Inventor: R. Bruce Spratt, Bountiful, Utah

[73] Assignee: OEC Medical Systems, Inc., Salt Lake City, Utah

[21] Appl. No.: 512,524

[22] Filed: Aug. 7, 1995

[51] Int. Cl.[6] ..... H05G 1/64

[52] U.S. Cl. ..... 378/98.7; 378/108

[58] Field of Search ..... 378/98.7, 95, 96, 378/97, 98.8, 108

[56] References Cited

U.S. PATENT DOCUMENTS

| | | | |
|---|---|---|---|
| 4,142,101 | 2/1979 | Yin . | |
| 4,423,521 | 12/1983 | Haendle et al. | 378/98.7 X |
| 4,809,309 | 2/1989 | Beckmans | 378/98.7 |
| 4,982,418 | 1/1991 | Kuehnel | 378/98.7 |
| 5,012,504 | 4/1991 | McFaul | 378/108 |
| 5,029,338 | 7/1991 | Aichinger et al. | 378/108 X |
| 5,485,501 | 1/1996 | Aichinger | 378/98.7 |
| B1 4,142,101 | 2/1991 | Yin . | |

OTHER PUBLICATIONS

XI Scan 1000 12"X 12" Track Mounted C–Arm Fluoro System Operating Guide, Part 1: General (5 Pages) no date.

FluroScan The Original Mini C–Arm (8 pages) no date.

Toshiba Corporation, Toshiba Electron Tube, Device & Equipment (11 pages) no date.

*Primary Examiner*—David P. Porta

*Attorney, Agent, or Firm*—Thorpe, North & Western, L.L.P.

[57] ABSTRACT

An automatic X-ray exposure control system and method for adjusting the X-ray dose/technique of X-ray diagnostic equipment to ensure sufficient doses/techniques for proper imaging while minimizing levels of radiation contacting the patient. The system includes traditional X-ray sources to generate a X-rays and traditional X-ray receivers for developing an image of a piece of anatomy through which the X-rays have passed. A mechanism for analyzing the intensity of the image is disposed adjacent the X-ray receiver and opposite the X-ray source. Typically, the mechanism is a CCD video camera which provides two outputs, the first output being absolute brightness as recorded by the camera. The video is analyzed by a windowing circuit or similar device to select an area of the image and restrict further processing of the image to that area. Circuits analyze the windowed area to detect the peak brightness and the average brightness within the windowed area. A microprocessor mathematically combines the readings to obtain a single value characteristic of the density of the piece of anatomy imaged by the X-ray equipment. The microprocessor then compares this value with one or more predetermined exposure control tables; determines the ideal dose/technique for imaging and adjusts the X-ray source to achieve ideal exposure. Through efficient and automatic management, the microprocessor can adjust the X-ray technique rapidly, thus reducing exposure time of X-rays. Furthermore, automatic adjustment may select predetermined techniques that minimize dose, and that are less obvious to some operators.

43 Claims, 4 Drawing Sheets

*emitting X-rays from an X-ray source, through a piece of anatomy and to an X-ray receiver so as to form an image;*

*determine absolute intensity for the image and process the image so as to select a windowed area of the image and restrict further processing to the windowed area containing anatomy of interest*

*determine the peak intensity and the average intensity within the windowed area*

*combine the peak intensity and the average intensity to give a single value representative of density for the anatomy being imaged*

*compare the single value against a predetermined exposure control table and adjust the emission of X-rays to achieve a desired exposure for the anatomy density as represented by the single value.*

*Fig. 4*

AUTOMATIC X-RAY EXPOSURE CONTROL SYSTEM AND METHOD OF USE

BACKGROUND OF THE INVENTION

1. Field of the Invention

The present invention relates to a system for controlling X-ray doses when imaging a portion of a patient's anatomy and, in particular, to a system and method for controlling X-ray exposure so as to achieve desired clarity in an X-ray image while minimizing the amount of radiation to which the patient is exposed.

2. The Background Art

The use of X-ray machines for imaging internal portions of a patient's anatomy has become wide spread due to the significant amount of useful information which can be provided. Fractures, sprains and abnormal circulatory conditions can all be diagnosed with little inconvenience to the patient by imaging the internal anatomy in question.

Unfortunately, X-ray diagnostic equipment has a serious draw-back which is of particular concern to patients receiving frequent X-rays. The radiation used to penetrate the anatomy and form the image is known to cause medical problems, such as cancer, if protective measures are not taken. For patients suffering from condition which require frequent imaging, the risks raised by repeated exposure to the X-ray radiation causes significant concerns.

While minimizing the patient's exposure to radiation is important, it is equally important to provide sufficient radiation to allow clear imaging of the internal features of the relevant body part. The accurate determination and setting of X-ray dose (Commonly referred to as technique), is difficult, however, due to the different densities of body parts. Thus, it is challenging to provide the correct X-ray technique, so as to give the best possible image, while simultaneously subjecting the patient to the least amount of radiation.

To resolve such concerns, attempts have been made to develop X-ray diagnostic equipment which automatically adjusts to give the appropriate technique. Automatic techniques using video brightness to achieve the appropriate dose have been tried with limited success. Such attempts generally have difficulty in accurately determining the proper dose in instances where there is raw X-ray in the image. Raw X-rays are those which have not been attenuated by passing through the patient's anatomy. An image of a body part, such as a hand, will contain, for example, attenuated X-rays, those passing through the palm and fingers, as well as unattenuated X-rays. The unattenuated X-rays pass between the fingers or about the outside edges of the hand. Because the desired amount of X-rays is only the dose necessary to penetrate the hand (or other portion of anatomy), the raw, unattenuated X-rays prevent an accurate determination of the proper dose.

Because the density of the tissue being X-rayed has a substantial effect on the attenuation of the X-rays, it is difficult to simply compensate for the particular portion of the anatomy which is being imaged. When imaging a substantial body part, such as a knee, the differences between the attenuated and unattenuated X-rays can be extreme. In such situations, the traditional automatic exposure control systems do not perform well. The traditional automatic system may result in insufficient technique, thereby resulting in an unclear image. In the alternative, the tradition automatic system may result in an excessive technique which is not only sufficient to form the image, but which subjects the patient to a much higher dose of radiation than is necessary.

The problem of exposure levels is particularly important in small C-arms, commonly referred to as "mini" C-arms, which have a opening of about 21 inches or less. The mini C-arms are often used to image extremities, such as hands, feet, knees and the like. Often, the mini C-arms are used in emergency rooms and other similar environments. Because of this, the mini C-arm is often moved from viewing one body part to another within a short period of time.

Those skilled in the art will appreciate that the exposure control systems on the mini C-arms tends to adjust with only moderate success. Thus, many patients are exposed to higher amounts of radiation than is necessary.

Thus there is a need for an improved automatic X-ray exposure control system which enables medical personnel or the system itself to control the X-ray diagnostic equipment to emit an X-ray dose which is sufficient to develop a clear image of the selected body part, while simultaneously keeping the radiation exposure to the patient at a minimum. Such a system desirably would compensate for widely varying anatomy and imaging requirements and be usable with conventional X-ray diagnostic equipment. Such a system would also be useable with mini C-arms.

SUMMARY OF THE INVENTION

Thus, it is an object of the present invention to provide an automatic X-ray exposure control system which enables medical personnel to obtain clear images of a variety of parts of a patient's body.

It is another object of the present invention to provide such an automatic X-ray exposure control system which minimizes the patient's exposure to X-ray radiation while ensuring a clear image of the area being viewed.

It is another object of the invention to provide such a system which is inexpensive and easy to use.

It is still another object of the present invention to provide such a system which can be used with conventional X-ray diagnostic equipment.

It is yet another object of the present invention to provide a method for controlling X-ray diagnostic equipment to obtain a clear image of the desired body part, while minimizing the radiation dose to which the patient is exposed.

It is an additional object of the invention to provide a method for analyzing X-ray images to provide an accurate determination of anatomy density in the area of interest and for modifying the X-ray technique responsive to the image analysis.

It is yet another object of the present invention to provide a method and apparatus for automatically controlling X-ray exposure which may be used on "mini" C-arms.

The above and other objects of the invention are realized in specific illustrated embodiments of an automatic X-ray exposure control system including an X-ray source for developing an X-ray beam to be directed through an area of anatomy and an X-ray receiver disposable opposite the body part so as to receive the X-ray beam and form an image of the area of anatomy contacted by the X-rays. Disposed adjacent the X-ray receiver is a mechanism for determining absolute intensity of the image obtained by the X-ray receiver. The image is then sent to a windowing circuit which selects an area of the image and confines dose determination to this area. The area selected will typically be an area of anatomy being imaged and preferentially, the specific area of interest within that portion of the patient's anatomy.

The windowed image, i.e. the area selected, is then sent to one or more circuits which determine the most intense part of the windowed image, i.e. peak intensity, which corresponds to the least dense portion of the windowed image, and the average intensity of the windowed area.

The peak intensity and average intensity are then combined to obtain a single value indicative of the density of the anatomy being imaged. The single value is then compared against an exposure control table which provides exposure settings for various anatomy density levels. If the exposure level is above that needed to generate a clear image of the anatomy desired, the X-ray source is adjusted downward to emit only sufficient X-rays to obtain the minimum desired level. If the exposure level is below that needed to generate a clear image, the X-ray source is adjusted to increase the amount of radiation to the minimum level necessary to obtain a clear image.

In accordance with one aspect of the invention, the X-ray receiver is an image intensifier which converts the X-rays received into visible light. The image of visible light is then processed based on absolute brightness of the image, and the circuits obtain readings for peak brightness and for average brightness within the windowed area.

In accordance with another aspect of the invention, a video camera is disposed adjacent to the X-ray receiver to store the image produced for further processing. Direct video (i.e. absolute brightness) is sent to the windowing circuit which selects the windowed area of video. The video image of the windowed area is then forwarded to the processing circuits. The circuits locate and measures the brightest portion of the window on a frame-by-frame basis. The circuits also determine the average brightness of the windowed area averaged over one or more frames. The two values are then combined and passed to a processor which compares the result once per frame to a table to thus provide the proper exposure setting for each value achieved.

In accordance with still another aspect of the invention, a microprocessor is in communication with the windowing circuit and instructs the circuit where to locate the windowed area with respect to the entire image so as to restrict further processing of portions of the image outside the window.

In accordance with an additional aspect of the invention, the windowed area is a variable, generally rectangular area selected from the round image created by the X-rays.

In accordance with another aspect of the invention, the windowed area may be selected so that no portion of the image within the windowed area is due to unattenuated X-rays striking the X-ray receiver.

In accordance with yet another aspect of the invention, a user interface is provided which allows manual selection of tables, so as to limit the range of X-ray exposure to which the patient is initially subjected, and to fine tune the system. Thus, for example, the operator of the system may indicate that the anatomy to be imaged is a hand. Because of the lower density of the anatomy, the X-ray source will emit an X-ray beam of lower intensity, and within a typical exposure range for such a body part.

In accordance with another aspect of the invention, the automatic exposure control system is disposed on a mini C-arm.

The method of the present invention includes the steps of emitting X-rays from an X-ray source, The method of the present invention includes the steps of emitting X-rays from an X-ray source, through a piece of anatomy and to an X-ray receiver so as to form an image; determining absolute intensity for the image and processing the image so as to restrict further processing to an area containing anatomy of interest; determining the peak intensity and the average intensity within the area and combining the two to obtain a single value which is representative of overall density for the anatomy of interest; matching the single value with a predetermined exposure control table; and adjusting the emission of X-rays to achieve a desired exposure for the overall anatomy density as represented by the single value.

BRIEF DESCRIPTION OF THE DRAWINGS

The above and other objects, features and advantages of the invention will become apparent from a consideration of the following detailed description presented in connection with the accompanying drawings in which:

FIG. 4 shows a flow chart of the steps of the present invention.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
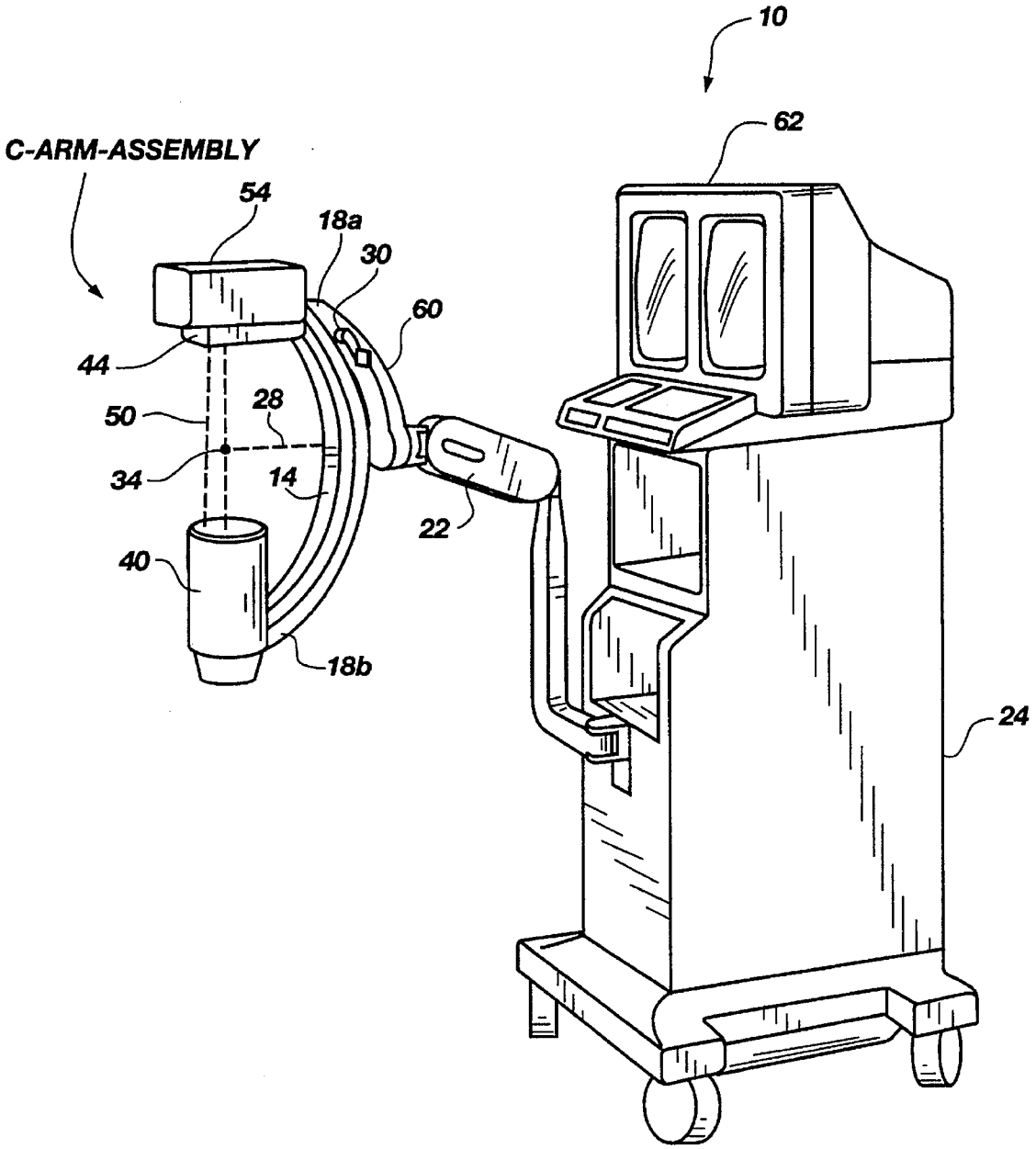
Fig. 1 (PRIOR ART)
FIG. 1 shows a side view of an X-ray diagnostic equipment mounted on a C-arm support structure made in accordance with the teachings of the prior art.

Referring to FIG. 1, there is shown a side view of prior art X-ray diagnostic equipment, generally indicated at 10, mounted to a C-shaped support apparatus, generally referred to as a C-arm 14. The C-arm 14 terminates in opposing upper and lower distal ends 18*a* and 18*b* on which the X-ray diagnostic equipment 10 is mounted.

The C-arm 14 is suspended by mobile support structure which includes a support arm 22 mounted upon a wheeled base 24. The support arm 22 allows the C-arm 14 to be laterally rotated either by having a rotatable attachment between the C-arm and the support arm, or by having a rotatable attachment between the support arm 22 and the wheeled base 24. When a person or a portion thereof is disposed between the distal ends 18*a* and 18*b* of the C-arm 14, lateral rotation of the C-arm changes the positions of the X-ray diagnostic equipment, thereby changing the view obtained in the resulting X-ray image.

The C-arm 14 is also typically attached to the support arm 22 in a slidable engagement 30 so at to enable sliding orbital motion of the C-arm about an axis of orbital rotation 34 to a selected position. The axis of orbital rotation 34 is preferably disposed at the center of curvature of the C-arm 14. The combination Of orbital and lateral rotation is beneficial in that it allows medical personnel to obtain a myriad of views of the portion of the patient's anatomy being imaged.

The views of the patient are made possible by an X-ray source 40 and an X-ray receiver 44. In the embodiment shown, the X-ray source 40 and X-ray receiver 44 are less than 30 inches apart. Therefore, they form what is commonly referred to as a mini C-arm.

The X-ray source 40 generates X-rays 50 which pass through the anatomy being imaged and contacts the X-ray receiver 44. The X-ray receiver 44 will typically be an image intensifier which converts the X-rays to visible light. The image is then captured in some sort of electronic form, such as video camera 54, and sent via a cable 60 to a remote location, such as the image-processing-and-display 62 for viewing and processing by medical personnel.

As was explained in the background section, a major problem with setting the X-ray source 40 is determining the proper level of X-ray exposure. If the exposure is too low, the images achieved will lack clarity and may require additional imaging. If the exposure is too high, the patient is subjected to unnecessary levels of radiation. This is of a particular concern when the patient is undergoing a procedure, such as the placement of a catheter, which requires numerous images to be produced as the procedure progresses. The unattenuated X-rays, i.e. those not passing through the patient's anatomy, interfere with prior art adjustment mechanisms and render them generally unreliable.

In accordance with the present invention, an improved automatic X-ray exposure control system has been developed to enable proper adjustment of the X-ray source 40 to provide the exposure level necessary to obtain a clear image without subjecting the patient amounts of radiation above that necessary to form a clear image.

Figure 2:
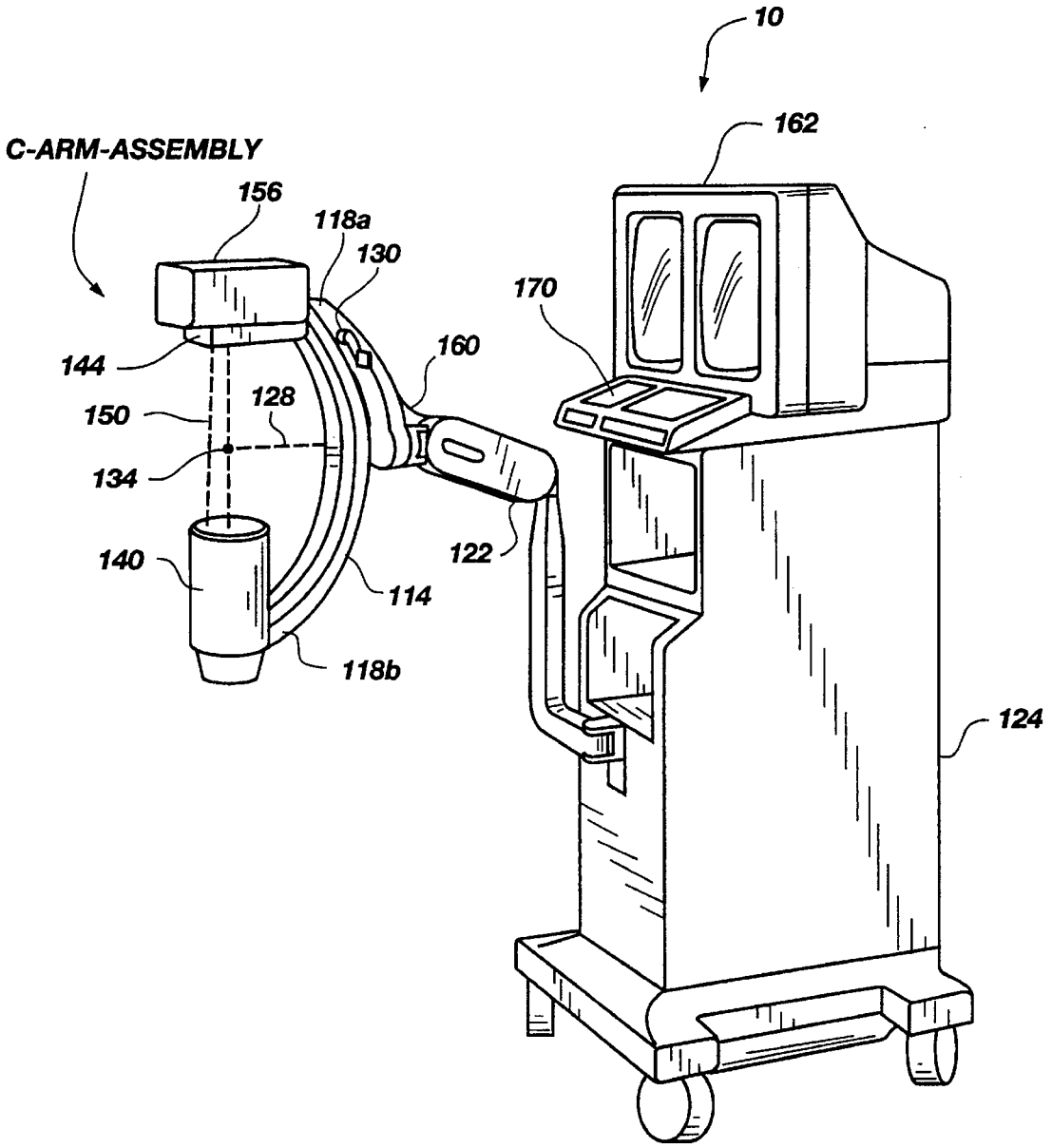
FIG. 2 shows a side view of X-ray diagnostic equipment mounted on a C-arm support, including structures arranged in accordance with the teachings of the present invention.

Referring now to FIG. 2, there is shown a side view of a C-arm 114 with diagnostic equipment, generally indicated at 110, made in accordance with the present invention. The C-arm 114 is attached to a support arm 122, which is attached to a wheeled base 124. The C-arm 114 can rotate about axis 128, as described in FIG. 1, and the attachment 130 between the C-arm 114 and the support arm 122 is slidable so as to enable the C-arm to rotate about the orbital axis 134.

The X-ray source 140 and X-ray receiver 144 are disposed at distal ends 118*a* and 118*b* of the C-arm. The X-ray source 140 is a typical X-ray generator as will be well known to those skilled in the art. The X-ray receiver 144 will typically be an image intensifier, as will also be well known in the art, which converts the X-rays received from the X-ray source 140 to visible light. The image obtained by the X-ray receiver 144 is converted to an electrical signal by appropriate means, such as a video camera 156. The use of the video camera 156 is advantageous in that it allows procedures to be monitored in real time.

The video camera 156 will typically be a solid state CCD camera. The video camera 156 detects the visible light and can monitor the intensity, i.e. brightness, of the image. Brightness of the image, as detected by the camera 156, is directly related to the intensity of the X-rays striking the image intensifier 144. The same video brightness, i.e. the same intensity of X-rays received by the X-ray receiver 144, is required to produce a good image independent of thickness or density of the anatomy being imaged. Thus, to obtain proper exposure, the X-ray intensity must be increased or decreased to compensate for varying levels attenuation through varying types of anatomy. However, as was mentioned in the background section, unattenuated X-rays interfere with simple approaches to determining the intensity of X-rays received by the X-ray receiver 144 and thus adjusting the X-ray source 140 in light of the same.

The CCD video camera 156 provides two outputs. The first is absolute video brightness, or direct video, which is used in the automatic exposure control system of the present invention. The second is automatic gain controlled (AGC) video which is directly supplied to the image-processing-and-display 162. Thus, with respect to the embodiment shown in FIG. 2, the AGC video could be transmitted, via the cable 160, to the image-processing-and-display 162, where it may be viewed by the person operating the diagnostic equipment 110. The amplitude of the AGC video is held relatively constant to provide a display with proper appearance.

Figure 3:
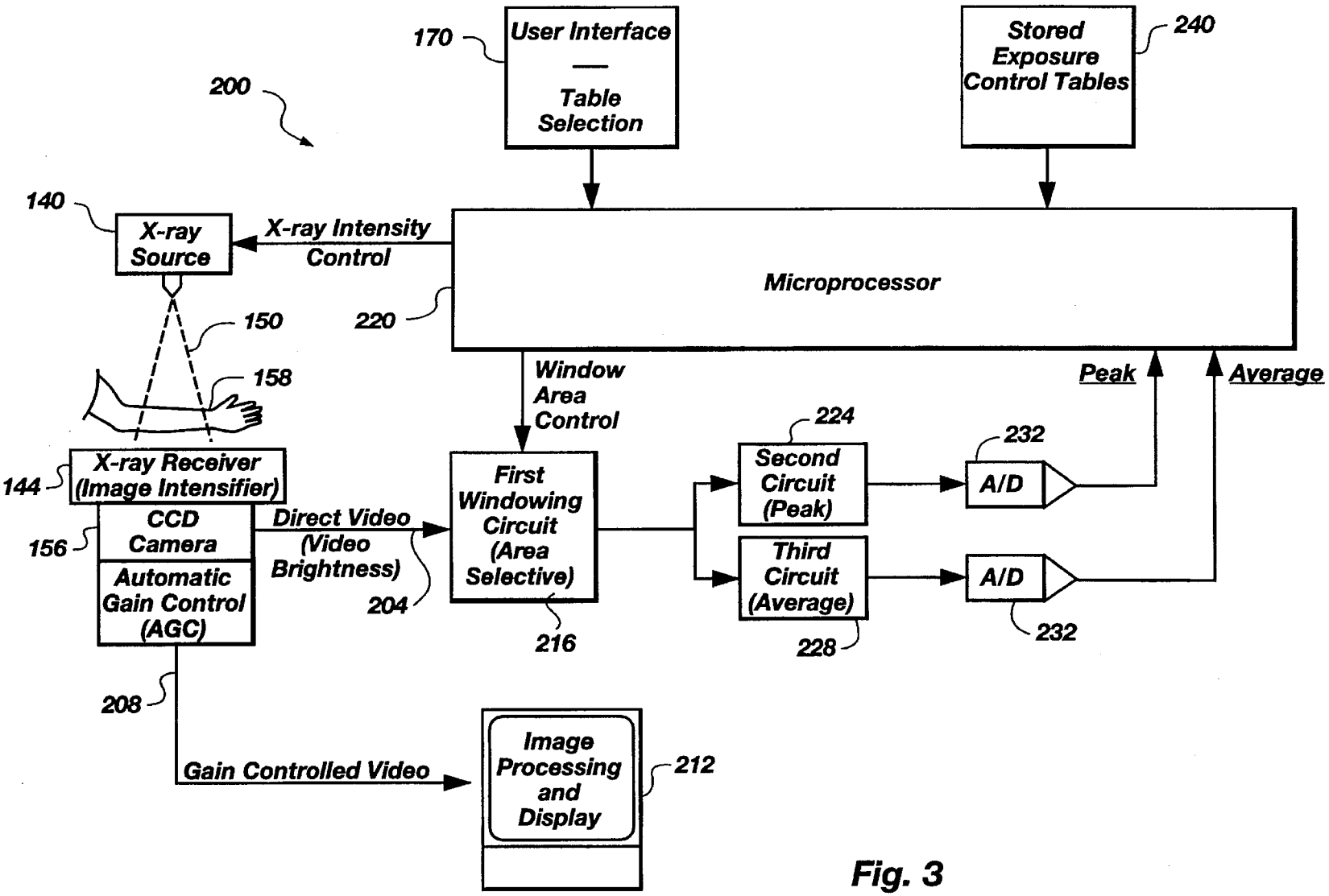
FIG. 3 shows a schematic view of an automatic X-ray exposure control systems made in accordance with the teachings of the present invention.

The direct video or absolute brightness is passed from the video camera 156 to a plurality of processors or circuits, shown in FIG. 3, which select an area within the image and then restrict further processing of the image to that area. The processors or circuits then obtain information as to peak brightness and average brightness within the selected area. The information as to peak brightness and average brightness is then passed to a processor (FIG. 3) which combines the two to achieve a single value which corresponds to the overall density of the portion of the anatomy which is being windowed. The processor then correlates the value with a predetermined table of optimum exposure levels for given anatomy densities. Based on the correlation between the value and the actual exposure emitted by the X-ray source 140, the operator, or the processor, can determine in what direction and to what extent, if any, the exposure produced by the X-ray source should be adjusted.

The adjustment may be made by a control panel, i.e. integrated with the control panel 170, or may be done automatically by the processor. Thus, if the exposure level is too high, the processor can adjust the X-ray tube voltage and current levels to reduce the dose to the appropriate level. Likewise, if the exposure level is too low, the processor can adjust the tube voltage and current levels to reach the minimum X-ray dose necessary to obtain a clear image of the patient's anatomy.

The automatic exposure control system 200 is particularly advantageous with a mini C-arm, such as C-arm 114. Because the C-arm 114 is primarily used for imaging extremities, any control system must be able to compensate for unattenuated light, such as that which is typically present when X-ray imaging a hand or foot. Prior art systems, however, have been relatively ineffective at compensation for the unattenuated X-rays which pass between the X-ray source 140 and the receiver 144 without passing through the patient.

By selectively processing the image, however, the mini C-arm 114 of the present invention overcomes the problems of the prior art. Analysis of the selected area of the image allows for accurate density determinations. As will be appreciated by those skilled in the art, the system can be arranged so that either a microprocessor or medical personnel choose the size and location of the area analyzed.

Referring now to FIG. 3, there is shown a schematic of an automatic control system, generally indicated at 200, in the form of a representative embodiment of the present invention. Beginning at the upper left, the X-ray source 140 is disposed above a fragmented human arm 158, so that the X-rays 150 pass therethrough. Those skilled in the art will appreciate that in many embodiments the X-ray source 140 will actually be disposed on the bottom, and the X-ray receiver 144 on top as is shown in FIGS. 1 and 2. Such an arrangement is commonly done to minimize the unattenuated radiation to which persons in the room are subject. By directing the X-rays upwardly, the X-ray back scatter may be diffused more away from the equipment operators.

Disposed below the X-ray receiver/image intensifier 144 is a CCD camera 156. The camera 156 records the image produced by the image intensifier 144 and provides first and second outputs, thereby acting as part of a first processing means. The first output 204 is absolute brightness/direct video, which is used to automatically control the X-ray exposure by the system of the present invention. The second output 208 is automatic gain controlled (AGC) video which is directly supplied to the image processing and display electronics 212 in a manner which will be known to those skilled in the art. Proper appearance of the AGC video is achieved by holding the amplitude relatively constant.

The absolute brightness/direct video 204 is passed through the remainder of a first processing means, which will typically be a windowing circuit 216, referred to hereafter as the first, windowing circuit. The first, windowing circuit 216 selects an area [hereinafter referred to as the windowed area or selected area] within the video image to further process, and restricts further processing (relative to the automatic exposure control) of the remainder of the image. The windowed area will typically be a variable rectangular area contained with a traditional, circular X-ray fluoroscopic image. The exact size and shape of the windowed area are managed under software control by a microprocessor 220. The microprocessor 220 is discussed in additional detail below.

The first, windowing circuit 216 restricts the portion of the image considered for dose determination to only the area containing the anatomy of interest, in the present example, the lower arm. In such a manner, raw/unattenuated X-rays are excluded from the windowed area, and therefore not considered in calculating the proper X-ray technique.

The windowed area is then presented to a second processing means, which will typically be two separate circuits, referred to herein as second, peak circuit 224 and third, average circuit 228. The second, peak circuit 224 is a peak detector which detects, frame-by-frame, the brightest part of the video image of the windowed area. This corresponds to the least dense portion of the anatomy present within the windowed area. The second, peak circuit 224 then generates a value/reading indicative of the peak brightness for the selected area.

The third, average circuit 228 detects, over one or more frames, the average brightness level within the windowed area. The resulting reading corresponds to the average overall density of the anatomy being imaged. Like the second, peak circuit 224, the third, average circuit 228 provides a value/reading for the windowed area—specifically a value/reading relative to the average brightness.

Signals indicating the values from the second, peak circuit 224 and the third, average circuit 228 are then passed to a third processing means, such as the microprocessor 220. Analog to digital converters 232 may be provided if the circuitry used provides analogue readings.

The microprocessor 220 mathematically combines the peak value/reading and the average value/reading obtained from the second and third circuits 224 and 228 to give a single value which represents the overall density characteristics of the anatomy being imaged—in the present case arm 158. The microprocessor 220 then compares predefined values contained in one or more exposure control tables 240 which are accessible by the microprocessor. The tables 240 contain specific X-ray tube voltage and current drive levels for various X-ray dose settings or techniques. The X-ray technique is then adjusted up or down, according to the tables 240, until the combined peak and average values indicate an ideal image. This will preferentially be done under control of the microprocessor 220 by varying the drive to the X-ray source 140. However, those skilled in the art will appreciate that such modifications could be made manually.

The operator interface 170 allows the selection of different tables as required by different imaging situations. For example, one table may be specially optimized for very dense anatomy, and another specially optimized for pediatric use.

As was mentioned previously, the microprocessor 220 is also in communication with the first, windowing circuit 216. Not only does the microprocessor 220 control the selection of the windowed area, it also allows the user, via the user interface 170, to bypass present windowing functions so that the windowed area can be adjustably controlled. Such is advantageous when the density of a very small area is particularly relevant to the clarity of image for a desired portion of the anatomy. This allows the user to operate in a fully automatic mode for most images, greatly enhancing the ease and quickness of use for the diagnostic equipment.

When the microprocessor 220 is used to control the first, windowing circuit 216, the microprocessor controls the size and location of the windowed area. Thus, the microprocessor 220 may be programmed to optimize the size of the windowed area so that the ultimate reading of overall density is taken from an sample of the anatomy obtain optimal imaging of the desired portion of the anatomy. The microprocessor 220 can also be used to limit the size of the windowed area to focus on some particular area of the anatomy within the image.

Those skilled in the art will appreciate that the system 200 described herein is only representative of one embodiment for practicing the present invention. For example, other means for measuring intensity of the attenuated and unattenuated X-rays could be used besides the camera, and other processing means could be used for selecting the windowed area. Likewise, the peak intensity and average intensity of the X-rays within the windowed area could be obtained by other processor means than the circuitry described. Those skilled in the art will be familiar with such equivalent structures and will be able to implement the same without undue experimentation.

Referring now to FIG. 4, there is shown a simple flow chart of the steps typically followed in carrying out the present invention. First, X-rays are emitted from an X-ray source, through a piece of anatomy and to an X-ray receiver so as to form an image; the image is then processed to determine absolute intensity for the image. In the embodiment discussed above, absolute intensity is measured in absolute brightness. However, other types of processing of the X-rays may also be used.

The image is then processed so as to restrict further processing to a windowed area containing anatomy of interest. By confining further processing to the windowed area containing the anatomy of interest, the raw, unattenuated X-rays which have interfered with the control systems of the prior art are eliminated from the exposure calculation.

The windowed area is then analyzed to determine peak intensity and average intensity for the windowed area. The value achieved for peak intensity and average intensity are combined to achieve a single value. The value achieved indicates the density characteristics of the anatomy imaged in the windowed area. The value is then compared to predetermined exposure control tables which provide appropriate doses/techniques for a given set of density characteristics. The dose/technique of the X-ray source is then modified to emit a more appropriate exposure. Repeated adjustments can be made if necessary. Under microprocessor 220 control, the adjustments can be made automatically and rapidly, thus eliminating excessive exposure time. Furthermore, automatic selecting may mall predetermined techniques that minimize dose and are less obvious to some operators.

In addition to the steps of the method set forth in FIG. 4, the method can further include manually selecting a table with respect to which the value representative of the density characteristics is analyzed. Also, the method may include using the user interface 170 to manually select the windowed area which is to be analyzed by the means for determining peak and average intensity, and for ultimate analysis of the density characteristics.

Thus there is disclosed an automatic X-ray exposure control system and method for using the same. The control system allows medical personnel to control X-ray exposure to obtain clear imaging of a selected piece of anatomy while simultaneously ensuring the patient is not being subjected to amounts of radiation that are larger than necessary by eliminating excessive exposure time. The invention includes a novel method for eliminating or minimizing the effects of unattenuated X-rays on the control system.

Those skilled in the art will recognize numerous modifications which may be made while not departing from the scope and spirit of the present invention. The appended claims are intended to cover such modifications.

What is claimed is:

1. A method for controlling X-ray exposure when imaging an area of anatomy, the method comprising:

(a) emitting X-rays from an X-ray source, through a piece of anatomy and to an X-ray receiver so as to form an image;

(b) determining absolute intensity for the image and selecting an area of the image containing anatomy of interest for further processing;

(c) determining the peak intensity and the average intensity within the selected area;

(d) combining the peak intensity and the average intensity to give a single value representative of density for the anatomy being imaged; and (e) comparing the single value against a predetermined exposure control table and adjusting the emission of X-rays to achieve a desired exposure for the anatomy density as represented by the single value.

2. The method for controlling X-ray exposure according to claim 1, wherein step (a) comprises, more specifically, emitting X-rays from an X-ray source, through a piece of anatomy and to an image intensifier so as to convert the X-rays into an image of visible light.

3. The method for controlling X-ray exposure according to claim 2, wherein step (b) comprises, more specifically, determining absolute brightness of the visible light and processing the image so as to restrict further processing to an area containing anatomy of interest.

4. The method for controlling X-ray exposure according to claim 3, wherein the method comprises using a video camera to detect the visible light.

5. The method for controlling X-ray exposure according to claim 4, wherein the camera provides a first output indicative of absolute video brightness.

6. The method for controlling X-ray exposure according to claim 5, wherein the camera provides a second output of automatic gain controlled video.

7. The method for controlling X-ray exposure according to claim 6, wherein the method comprises supplying the second output to a processing means for processing the image and a display means for displaying the image.

8. The method for controlling X-ray exposure according to claim 5, wherein the method comprises processing the first output so as to restrict further processing to a windowed area containing anatomy of interest.

9. The method for controlling X-ray exposure according to claim 8, wherein the method comprises, more specifically, passing the first output through a windowing circuit which selects an area contained within the image.

10. The method for controlling X-ray exposure according to claim 9, wherein the area selected by the windowing circuit is rectangular.

11. The method for controlling X-ray exposure according to claim 8, wherein step (c) comprises, more specifically, using at least one circuit to analyze the windowed area and determine a peak brightness of the selected area and an average brightness for the windowed area.

12. The method for controlling X-ray exposure according to claim 11, wherein the step (d) comprises, more specifically, generating a first signal representing the peak brightness of the windowed area and a second signal representing the average brightness of the windowed area, and combining the first and second signals to obtain a single value representative of the density characteristic of the anatomy imaged.

13. The method for controlling X-ray exposure according to claim 12, wherein step (e) comprises, more specifically, comparing the single value against a table containing predetermined exposure control levels matched to density characteristics and adjusting X-ray tube voltage/current levels supplied to an X-ray source until the combined peak and average brightness levels indicate an ideal image as determined by the table.

14. The method for controlling X-ray exposure of claim 3, wherein step (c) comprises, more specifically, determining the peak brightness and average brightness within the windowed area containing the anatomy of interest.

15. The method for controlling X-ray exposure of claim 1, wherein the method comprises forming the image in a video medium.

16. The method for controlling X-ray exposure of claim 1, wherein step (b) further comprises restricting further processing of the image to a selected area of the image containing no unattenuated X-rays.

17. The method for controlling X-ray exposure of claim 16, wherein the method further comprises defining a generally rectangular area containing no unattenuated X-rays, and adjusting the windowed area to optimize size of the windowed area without including areas of the image having unattenuated X-rays.

18. The method for controlling X-ray exposure of claim 16, wherein the method further comprises automatically adjusting the selected area of the image so as to obtain an optimum sized area not containing unattenuated X-rays.

19. The method for controlling X-ray exposure of claim 18, wherein the method further comprises using a common microprocessor to receive the peak intensity and average intensity and to select the area of the image to be restricted from further processing so as to vary the area restricted from further processing responsive to the peak intensity and average intensity.

20. The method for controlling X-ray exposure of claim 1, wherein step (b) comprises using a processor to automatically control size and location of the selected area.

21. The method for controlling X-ray exposure of claim 1, wherein step (b) comprises manually controlling size and location of the selected area.

22. The method according to claim 1, wherein step (a) comprises disposing the X-ray source and X-ray receiver of a mini C-arm about an extremity of the patient.

23. An automatic X-ray Exposure Control System comprising:

X-ray generation means for developing an X-ray beam;

X-ray receiver means foe receiving X-rays developed by the X-ray generation means and developing an image;

first processor means in communication with the X-ray receiver means for determining absolute intensity of the image, and for restricting further processing of the image to a selected area of the image containing anatomy of interest;

second processor means in communication with the first processor means for determining the peak intensity and the average intensity within the selected area; and third processor means for analyzing the peak intensity and the average intensity and for adjusting emission of X-rays from the X-ray generation means responsive to the peak intensity and average intensity so as to achieve a desired exposure, and wherein the third processor means is disposed in communication with the first processor means and the second processor means such that the third processor means may signal the first processor means to alter the selected area responsive to signals received from the second processor means.

24. The system according to claim 23, wherein the X-ray receiving means comprises an image intensifier for converting X-rays into visible light.

25. The system according to claim 23, wherein the first processor means comprises a solid state CCD video camera.

26. The system according to claim 23, wherein the first processor means comprises a selective area windowing circuit for restricting further processing of the image.

27. The system according to claim 24, wherein the first processor means further comprises means for automatically selecting size and location of the selected area.

28. The system according to claim 27, wherein the first processor means further comprises means for manually selecting size and location of the selected area.

29. The system according to claim 23, wherein the second processor means comprises a circuit for determining peak brightest of the selected area of the image, and a circuit for determining the average brightness of the selected area of the image.

30. The system according to claim 23, wherein the system further comprises storage means in communication with the third processor means for storing predetermined exposure control tables correlating anatomy density characteristics to X-ray exposure levels.

31. The system according to claim 30, wherein the system further comprises user interface means in communication with the third processor means for manually selecting exposure control tables.

32. The system according to claim 23, wherein the third processor means comprises a microprocessor disposed in communication with the X-ray generation means.

33. The system according to claim 23, wherein the system further comprises fourth processor means for processing and displaying the image developed by the X-ray receiver means.

34. The system according to claim 33, wherein the fourth processor means is disposed in communication with the first processor means.

35. An automatic X-ray Exposure Control System for mini C-arms comprising:

a C-arm X-ray diagnostic apparatus having an X-ray generation means for developing an X-ray beam and an X-ray receiver means for receiving X-rays developed by the X-ray generation means and developing an image, the X-ray source and X-ray receiver being disposed on opposing ends of a generally C-shaped support structure so that the X-ray source and X-ray receiver are disposed within thirty inches of one another;

first processor means disposed at least partly on the C-arm and in communication with the X-ray receiver means for determining absolute intensity of the image, and for selecting an area of the image containing anatomy of interest for further processing;

second processor means in communication with the first processor means for determining the peak intensity and the average intensity within the selected area; and third processor means for analyzing the peak intensity and the average intensity and for adjusting emission of X-rays from the X-ray generation means responsive to the peak intensity and average intensity so as to achieve a desired exposure.

36. The system according to claim 35, wherein the X-ray receiving means comprises an image intensifier for converting X-rays into visible light.

37. The system according to claim 36, wherein the first processor means comprises a solid state CCD video camera disposed above the image intensifier on the C-arm.

38. The system according to claim 35, wherein the first processor means comprises a selective area windowing circuit for restricting further processing of the image.

39. The system according to claim 35, wherein the second processor means comprises a circuit for determining peak brightest of the selected area of the image, and a circuit for determining the average brightness of the selected area of the image.

40. The system according to claim 35, wherein the first processor means further comprises a microprocessor for automatically selecting size and location of the selected area.

41. The system according to claim 35, wherein the first processor means further comprises a means for manually selecting size and location of the selected area, said means comprising a microprocessor and a user interface.

42. An automatic X-ray Exposure Control System comprising:

X-ray generation means for developing an X-ray beam;

X-ray receiver means for receiving X-rays developed by the X-ray generation means and developing an image;

first processor means in communication with the X-ray receiver means for determining absolute intensity of the image, and for restricting further processing of the image to a selected area of the image containing anatomy of interest;

second processor means in communication with the first processor means for determining the peak intensity and the average intensity within the selected area; and third processor means for analyzing the peak intensity and the average intensity and for adjusting emission of X-rays from the X-ray generation means responsive to the peak intensity and average intensity so as to achieve a desired exposure.

43. The automatic X-ray Exposure Control System as defined in claim 42 wherein the third processor means is disposed in communication with the first processor means and the second processor means such that the third processor means may signal the first processor means to alter the selected area responsive to signals received from the second processor means.

* * * * *